United States Patent [19]

Vatis et al.

[11] 4,242,614

[45] Dec. 30, 1980

[54] LIGHTING CONTROL SYSTEM

[75] Inventors: Dimitrios Vatis, East Flat Rock; Charlie B. Turner, Hendersonville, both of N.C.

[73] Assignee: General Electric Company, Schenectady, N.Y.

[21] Appl. No.: 15,077

[22] Filed: Feb. 26, 1979

[51] Int. Cl.[3] ..... H05B 41/39

[52] U.S. Cl. ..... 315/153; 315/158; 315/284; 315/291; 315/294; 315/324; 340/694

[58] Field of Search ..... 315/291, 292, 294, 312, 315/324, 153, 154, 158, DIG. 4, 284; 325/37, 302

[56] References Cited

U.S. PATENT DOCUMENTS

| | | | |
|---|---|---|---|
| 3,590,271 | 6/1971 | Peters | 325/37 X |
| 3,689,886 | 9/1972 | Durkee | 340/310 X |
| 3,816,794 | 6/1974 | Snyder | 315/310 X |
| 3,873,910 | 3/1975 | Willis, Jr. | 315/DIG. 4 |
| 3,971,028 | 7/1976 | Funk | 340/310 A X |
| 3,989,976 | 11/1976 | Tabor | 315/291 |
| 4,016,451 | 4/1977 | Engel | 315/158 |
| 4,037,148 | 7/1977 | Owens et al. | 315/308 X |
| 4,095,139 | 6/1978 | Symonds et al. | 315/294 X |
| 4,144,478 | 3/1979 | Nuver | 315/291 |
| 4,169,259 | 9/1979 | Hidler et al. | 340/310 R |

FOREIGN PATENT DOCUMENTS

| | | | |
|---|---|---|---|
| 2311751 | 9/1974 | Fed. Rep. of Germany | 315/154 |
| 2700503 | 7/1978 | Fed. Rep. of Germany | 315/153 |

*Primary Examiner*—Eugene R. LaRoche

*Attorney, Agent, or Firm*—Sidney Greenberg; Lawrence R. Kempton; Philip L. Schlamp

[57] ABSTRACT

System for controlling operation of a plurality of gaseous discharge lamps for selectively turning on or off one or more of the lamps and producing desired lumen output of the lamps as needed, to provide for conservation of electrical energy. In the system, each of the discharge lamps is connected to a separate variable impedance ballast device, a control circuit for varying the impedance of each ballast device, and a signal processing circuit connected to each control circuit for operating the same, and a signal transmitting device for transmitting information to each of the signal processing circuits, whereby the latter circuits selectively operate the respective control circuits in response to the information received from the signal transmitting device. In a preferred embodiment, the signal transmitting device is a remote transmitter such as a radio frequency signal device for remote control of the lighting system.

11 Claims, 4 Drawing Figures

LIGHTING CONTROL SYSTEM

The present invention relates to lighting control systems, and more particularly concerns a control system for regulating the operation of gaseous discharge lamps.

It is an object of the invention to provide a control system for controlling the operation and light level of one or a group of gaseous discharge lamps, particularly of the high intensity discharge type.

Another object of the invention is to provide a control system of the above type for control of luminaire energy consumption.

A further object of the invention is to provide for remote control of the above type of lighting control system.

Still another object of the invention is to provide a lighting (luminaire) control system for affording energy savings to the user without affecting normal light distribution patterns.

A particular object of the invention is to provide a lighting control system of the above type which enables the user to turn individual lighting fixtures on and off as well as to operate the respective light fixtures at the light (or energy) level desired over any work area at the discretion of the user, and further to provide for remote control of such a lighting system.

Other objects and advantages will become apparent from the following description and the appended claims.

With the above objects in view, the invention in one of its aspects relates to a lighting control system comprising, in combination, a plurality of gaseous discharge lamp loads connected in parallel, voltage supply means for the lamp loads, a plurality of variable impedance ballast means connected between the voltage supply means and each lamp load, a plurality of control means respectively connected to the plurality of variable impedance ballast means for controlling the light level of the lamp loads, signal means for transmitting information signals, and a plurality of signal processing means arranged to receive information signals from the signal means and connected respectively to the plurality of control means for operating each control means in response to the received information signals.

The invention will be better understood from the following description taken in conjunction with the accompanying drawings, in which.

Figure 1:
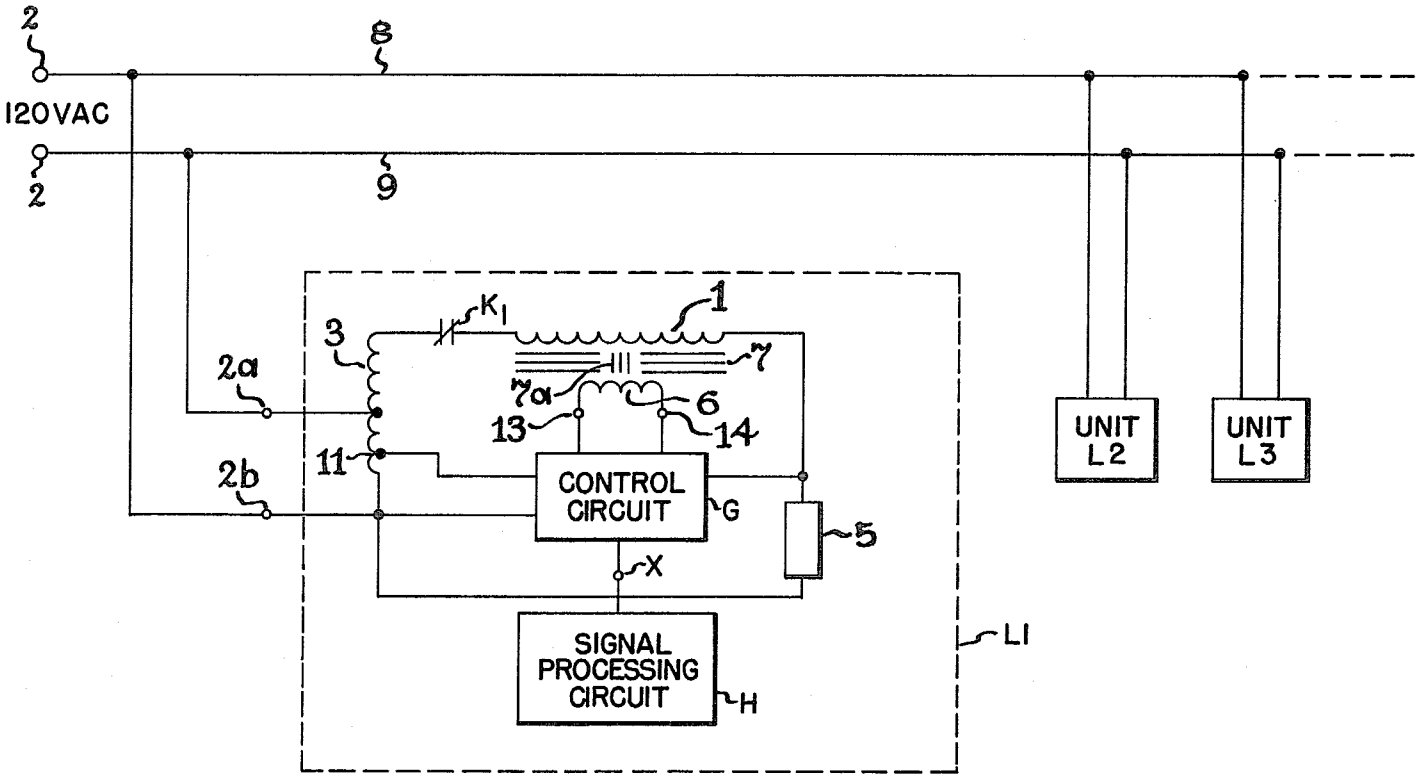
FIG. 1 is a schematic diagram showing the arrangement of components of a discharge lamp operating and control circuit embodying the invention for controlling a plurality of lighting units.

Referring now to the drawings, and particularly to FIG. 1, there is shown a lighting control system in accordance with an embodiment of the invention comprising a plurality of lighting units L1, L2, L3, connected in parallel to terminals 2 of a source of alternating current by means of conductors 8 and 9. While only three lighting units are shown, it will be understood that any desired number of lighting units may be included in the illustrated system. The description below of the structure, functions and operation of lighting unit L1 also applies to the other lighting units of the system.

Figure 4:
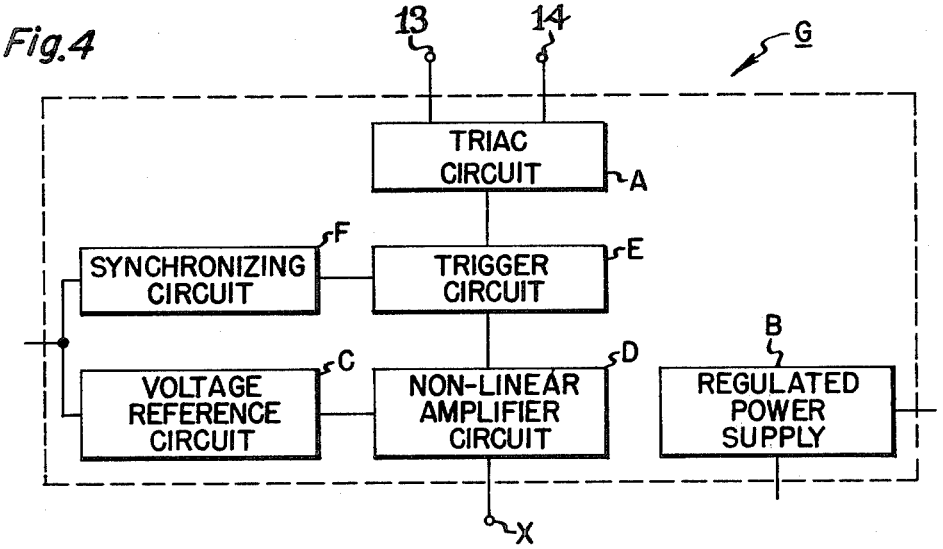
FIG. 4 is a schematic block diagram of the control circuit shown in FIG. 1.

The circuit of lighting unit L1 comprises a variable inductive ballast reactor comprising main winding 1 connected at one side by autotransformer 3 to terminal **2*a* connected to the alternating current supply and at its other side is connected in series with discharge lamp 5, which is typically a mercury vapor, sodium vapor or other type of high intensity discharge (HID) lamp. Lamp 5 is connected at its other side to supply terminal 2*b*. Control winding 6 is arranged inductively coupled to main winding 1, the control winding being typically wound on magnetic core 7 on opposite sides of magnetic shunt 7*a*. Control winding 6 is connected at opposite sides via terminals 13 and 14 to control circuit G. Included in control circuit G, as seen in FIG. 4, is triac circuit A which comprises a triac semiconductor switch (not shown) connected in series with control winding 6. Firing of the triac switch operates to control the current flowing through main winding 1 and thereby control the wattage (power) to lamp 5**. The structure, function and operation of this variable impedance ballast control device are more fully described in U.S. Pat. No. 3,873,910—Willis, issued Mar. 25, 1975 and assigned to the same assignee as the present invention, and the disclosure thereof is accordingly incorporated herein by reference.

In a preferred embodiment of the present invention, control circuit G, connected as shown to control winding 6, lamp 5, autotransformer 3, supply terminal **2*b* and signal processing circuit H (which is more fully described below), is of the type which provides substantially constant wattage to the lamp to maintain its light output at the desired level. For this purpose, there are provided in the circuit, as seen generally in FIG. 4, a power supply circuit B connected to autotransformer 3 for providing a voltage regulated direct current supply, a trigger circuit E for firing the triac in circuit A at a predetermined phase interval as more fully explained below, a non-linear (differential) amplifier circuit D connected to trigger circuit E for controlling the phase interval at which the triac is fired, a synchronizing circuit F connected between lamp 5 and trigger circuit E for restarting the phase interval at zero lamp voltage for firing the triac, and a voltage reference circuit C connected between lamp 5 and non-linear amplifier circuit D for controlling the operation of the latter circuit in response to the lamp voltage. In the operation of these circuits, power supply circuit B provides a positive regulated d-c voltage to the non-linear amplifier, trigger and synchronizing circuits and also provides a positive unregulated d-c voltage to the non-linear amplifier and trigger circuits. The input of power supply circuit B is connected to tap 11 on autotransformer 3 (see FIG. 1**) to obtain a low voltage supply, e.g., about 17 volts.

The structure, function and operation of the above-described control circuit are disclosed in detail in U.S. Pat. No. 4,037,148—Owens et al, issued July 19, 1977 and assigned to the same assignee as the present invention, and the disclosure thereof is accordingly incorporated herein by reference, making it unnecessary to disclose the same in further detail herein.

The invention described in the aforementioned Owens et al patent provides for substantially constant wattage regulation of the lamp by compensating for variations in line voltage and lamp characteristics, and the control circuit there disclosed produces substantially constant lamp lumen output throughout the operational life of the HID lamp. The present invention not only provides the foregoing benefits as well as other advantages of the Owens et al invention, but further provides for different light levels of the lamp at the discretion of the user, both with respect to an individual lamp and to a plurality of lamps for optimum utilization or conservation of electrical energy of the lighting system.

In accordance with the present invention, means are provided to enable the user to actuate the control circuit of each lighting unit of a group of lighting units selectively in a manner which is similar or different with regard to the other lighting units, and by such actuation to provide the desired light level for each lighting unit or to turn off any of the lighting units. In a preferred embodiment, remote control means are provided for operating the control circuits from a location remote from the lighting units.

In the embodiment shown in FIG. 1, each lighting unit includes a signal processing circuit H connected at Junction X to control circuit G. A typical signal processing circuit as shown in the block diagram of FIG. 3 comprises signal receiver 15 which receives information signals from the signal system shown in FIG. 2 and described more fully below, the signal receiver 15 being connected to signal decoder 16 which in turn is connected to the input of decoder latch 17. Connected between the output of decoder latch 17 and junction X, to which control circuit G is connected, are a plurality of parallel-connected resistors of different values of which only $R_1$, $R_2$, and $R_3$ are shown. Decoder latch 17 is also connected to relay coil K which has normally closed contacts $K_1$ connected in series between alternating current supply autotransformer 3 and ballast reactor 1 (see FIG. 1).

Figure 2:
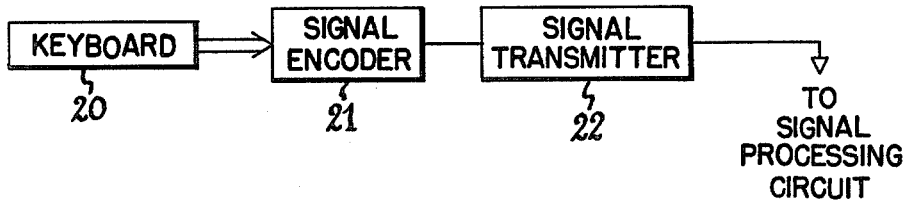
FIG. 2 is a block diagram of a signal transmitting device which may be employed for remote control of the lighting system shown in FIG. 1.
Figure 3:
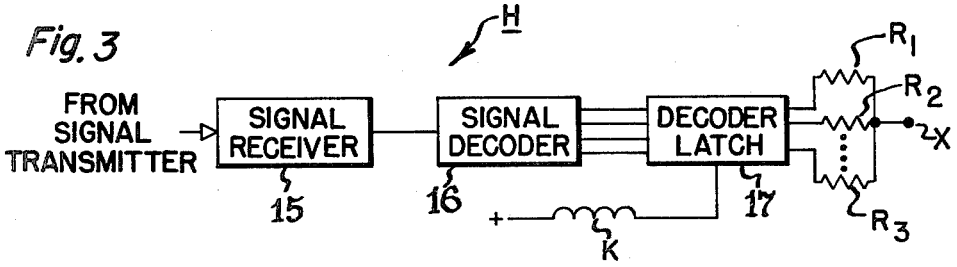
FIG. 3 is a schematic block diagram of the signal processing circuit shown in FIG. 1.

The signal transmitting system shown in FIG. 2 comprises keyboard 20 connected to signal encoder 21 which in turn is connected to signal transmitter 22, the latter output being transmitted in any of a variety of transmission media to signal receiver 15 of signal processing circuit H. Thus, for remote control of the lighting control system by radio waves, signal transmitter 22 may be constituted by a conventional radio frequency (RF) transmitter coupled with a sending antenna, in which case signal receiver 15 would comprise a corresponding radio receiver and receiving antenna of known types. Alternatively, where a direct wire connection between the remote control system and the controlled lighting units is desired, such a direct wire connection would constitute both signal transmitter 22 and signal receiver 15. Other forms of signal transmission could be employed, such as infrared light or laser beams, ultrasonic frequencies, etc.

Keyboard 20 may be of known type and comprises typically a plurality of selectively operated switches for selectively connecting the various inputs of encoder device 21. While in a usual case the keyboard is manually operated to transmit the desired information signals to encoder device 21, it is within the scope of the invention to effectively operate the keyboard automatically, such as by appropriately connecting the transmitting means to other devices such as a real time clock, telephone, light sensors, or various energy management controls for operating the lighting control system in accordance with different conditions, as for example, the particular time of day, the level of ambient light, the areas to be illuminated, etc.

Signal encoder 21, in response to and in accordance with the information received from keyboard 20, generates an electrical signal representing such received information and feeds such information signals to signal transmitter 22.

Signal decoder 16 receives the information via signal receiver 15 in the format generated by signal encoder 21 and produces suitable electrical signals to represent this information for transmittal to decoder latch 17.

Signal encoder 21, signal decoder 16, and decoder-latch 17 typically are integrated circuit (IC) components of known commercially available type. Thus, signal encoder 21 may be an IC designated SAA1024 available from ITT Company, or an IC designated S2600 available from American Microsystems, Inc. (AMI). The output of these IC's is a coded signal such as a different frequency for each keyboard function selected. These frequencies are transmitted to the remote signal processing circuit H located in each luminaire unit. The signal processing circuit receives the transmitted signals via signal receiver 15, which may amplify the signals if necessary, the signals being fed to the signal decoder devices for processing prior to transmittal to control circuit G. Decoder 16 may be ITT's SAA1025 IC for use with the aforementioned ITT encoder IC, or may be AMI's S2601 IC for use with the aforementioned AMI IC encoder.

Decoder-latch 17 may be of a known commercially available type of IC such as that designated CD4515 of RCA Corporation. In the described arrangement, this component receives the binary decoded information from signal decoder 16 and latches an appropriate electronic switch closed. The closing of this switch either activates relay K or connected one of the plurality of resistors such as $R_1$, $R_2$, $R_3$ to junction X which corresponds to junction X shown in the circuit of FIG. 4 of the aforementioned Owens et al patent, and accordingly the resistor will correspond to $R_4$ or $R_5$ shown in the latter circuit. Depending on the particular value of the resistor thus connected, control circuit G will control the lamp wattage to provide the desired lumen output. When relay K is activated, it opens the normally closed relay contacts $K_1$ to turn the lamp off.

Where desired, known types of microcomputer or microprocessor based circuitry with appropriate programming may be employed in place of the encoder and decoder devices described above.

In a particular embodiment of the described invention, each signal processing receiver may be so coded as to provide a different address code for each lighting unit and so as to respond only to a particular code transmitted by the signal transmitting system.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Lighting control system comprising, in combination, a plurality of gaseous discharge lamp loads connected in parallel, voltage supply means for said lamp loads, a plurality of variable impedance ballast means connected between said voltage supply means and each said lamp load, a plurality of control means respectively connected to said plurality of variable impedance ballast means for controlling the light level of said lamp loads, signal means for transmitting information signals, and a plurality of signal processing means arranged to receive information signals from said signal means and connected respectively to said plurality of control means for operating each said control means in response to the received information signals, said ballast means comprising a pair of inductively coupled coils, one of said coils arranged in series with said lamp load, the other of said coils connected to said control means for control of the current in said one coil.

2. A system as defined in claim 1, at least certain of said plurality of signal processing means having an electronic address code different from the electronic address code of others of said plurality of signal processing means, said signal means having means for transmitting different signals corresponding to said different electronic address codes of said plurality of signal processing means, whereby said plurality of signal processing means selectively operate the respective control means associated therewith.

3. A system as defined in claim 1, said signal processing means having output means operating in conjunction with said control means for providing different predetermined light levels for said lamp while providing substantially constant wattage for each predetermined light level.

4. A system as defined in claim 3, including switch means connected to said lamp load and controlled by said signal processing means for turning off said lamp load.

5. A system as defined in claim 4, said output means of said signal processing means comprising a plurality of parallel-connected impedance means of different impedance values connected to said control means.

6. A system as defined in claim 1, said signal means comprising information input means, signal encoder means connected to said information input means for generating electrical signals representing information received therefrom, and signal transmitter means connected to said signal encoder means for transmitting said information signals to said signal processing means.

7. A system as defined in claim 6, said signal processing means comprising signal receiver means and signal decoder means for receiving said information signals from said signal receiver means and producing electrical signals representing said information for transmittal to said control means.

8. A system as defined in claim 1, wherein said signal means and said signal processing means are directly connected by electrical conductor means.

9. A system as defined in claim 1, wherein said signal means comprises wireless transmitter means for transmitting information signals to said signal processing means.

10. A system as defined in claim 9, wherein said transmitter means comprises a radio frequency transmitter.

11. A system as defined in claim 9, wherein said transmitter means comprises an infrared light beam transmitter.

* * * * *